US009546509B2

(12) United States Patent
Siekierka et al.

(10) Patent No.: US 9,546,509 B2
(45) Date of Patent: Jan. 17, 2017

(54) HINGE

(75) Inventors: Andreas Siekierka, Recklinghausen (DE); Roman Pyschik, Remscheid (DE)

(73) Assignee: PRÄMETA GMBH & CO. KG, Troisdorf (DE)

( * ) Notice: Subject to any disclaimer, the term of this patent is extended or adjusted under 35 U.S.C. 154(b) by 0 days.

(21) Appl. No.: 14/122,209

(22) PCT Filed: May 18, 2012

(86) PCT No.: PCT/EP2012/059267

§ 371 (c)(1),
(2), (4) Date: Nov. 25, 2013

(87) PCT Pub. No.: WO2012/159990

PCT Pub. Date: Nov. 29, 2012

(65) Prior Publication Data

US 2014/0082887 A1 Mar. 27, 2014

(30) Foreign Application Priority Data

May 25, 2011 (DE) ..... 20 2011 101 342 U

(51) Int. Cl.
*E05D 7/04* (2006.01)

(52) U.S. Cl.
CPC ..... *E05D 7/0415* (2013.01); *E05D 7/04* (2013.01); *E05D 2007/0469* (2013.01); *E05D 2007/0484* (2013.01); *E05Y 2201/716* (2013.01); *E05Y 2201/722* (2013.01); *E05Y 2800/692* (2013.01); *E05Y 2900/20* (2013.01); *Y10T 16/5322* (2015.01)

(58) Field of Classification Search
CPC ..... E05D 7/0415; E05D 7/0423
USPC ..... 16/237, 238, 240, 245, 246
See application file for complete search history.

(56) References Cited

U.S. PATENT DOCUMENTS

| | | | | | |
|---|---|---|---|---|---|
| 3,916,481 | A | * | 11/1975 | Pittasch | 16/245 |
| 4,159,557 | A | * | 7/1979 | Pittasch et al. | 16/237 |
| 5,133,109 | A | * | 7/1992 | Mariani | 16/238 |
| 5,283,929 | A | * | 2/1994 | Lin | 16/237 |
| 5,603,142 | A | * | 2/1997 | Dubach et al. | 16/247 |
| 6,058,564 | A | * | 5/2000 | Purcell et al. | 16/241 |

(Continued)

FOREIGN PATENT DOCUMENTS

| | | |
|---|---|---|
| DE | 10 2008 003557 A1 | 7/2009 |
| JP | 2004-324059 A | 11/2004 |

OTHER PUBLICATIONS

International Search Report mailed Aug. 21, 2012 in corresponding PCT Application No. PCT/EP2012/059267.

(Continued)

*Primary Examiner* — David E Sosnowski
*Assistant Examiner* — Jason W San
(74) *Attorney, Agent, or Firm* — Maier & Maier, PLLC

(57) ABSTRACT

In the case of a hinge having a body hinge part which can be preassembled on a body and a door hinge part which can be preassembled on a door leaf, wherein the hinge parts are connected to each other in an articulated manner, provision is made for the body and door hinge parts to have respective flange parts fastenable onto a surface, and a height- and depth-adjusting device is arranged in the body flange part and has at least one first fastening element which can be used to fix the set height and depth position of the door leaf in relation to the body.

13 Claims, 5 Drawing Sheets

(56) References Cited

U.S. PATENT DOCUMENTS

Figure 1:
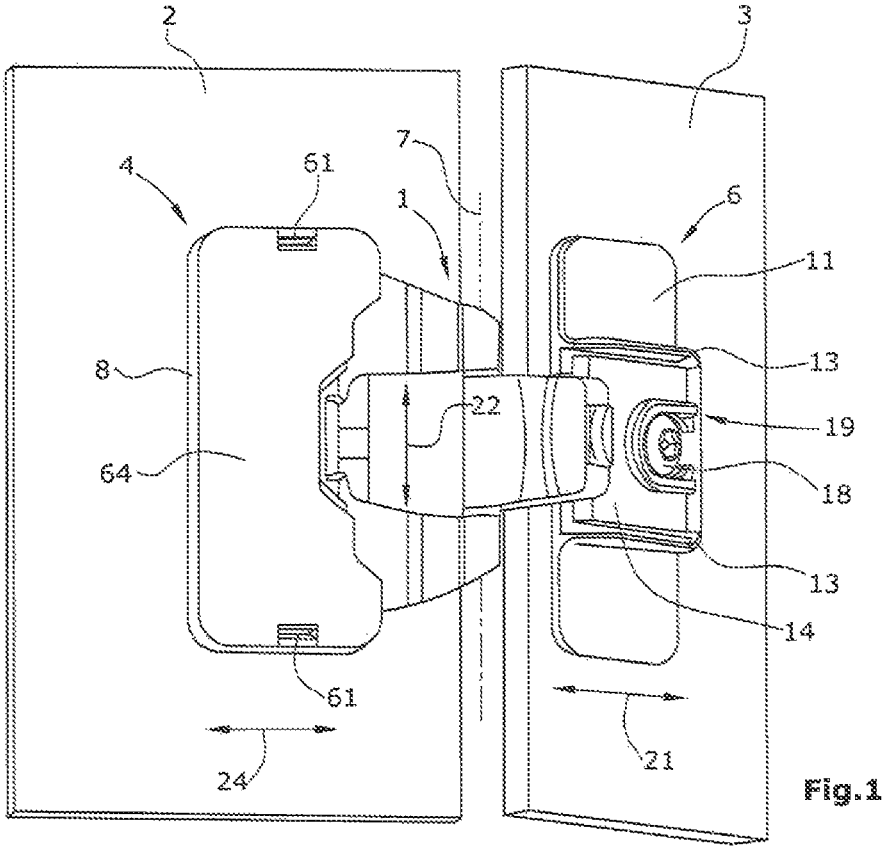

| | | | | |
|---|---|---|---|---|
| 6,233,783 | B1 * | 5/2001 | Dubach | 16/237 |
| 6,622,343 | B2 * | 9/2003 | Rupprechter | 16/242 |
| 6,918,158 | B2 * | 7/2005 | Isele | 16/235 |
| 8,387,212 | B2 * | 3/2013 | Pecar et al. | 16/242 |
| 9,416,573 | B2 * | 8/2016 | Sabrowski | E05D 7/0415 |
| 2004/0128794 | A1 * | 7/2004 | Chung | 16/236 |
| 2004/0163213 | A1 * | 8/2004 | Isele | 16/245 |
| 2005/0183238 | A1 * | 8/2005 | McCue et al. | 16/236 |
| 2007/0028420 | A1 * | 2/2007 | Lueffe et al. | 16/382 |
| 2008/0016648 | A1 * | 1/2008 | Lautenschlager | 16/238 |

OTHER PUBLICATIONS

Japanese Office Action dated Apr. 26, 2016, in connection with corresponding JP Application No. 2014-511823 (9 pgs., including partial English translation).

* cited by examiner

HINGE

The invention relates to a hinge comprising a corpus-side hinge part adapted to be pre-assembled and a door-side hinge part adapted to be pre-assembled to a door leaf as defined in the precharacterizing part of claim 1.

Multiple-joint hinges often provide the possibility of three-dimensional adjustment at the frame part in a hinge arm and, due to the joint mechanism, generally have a restricted opening angle. Since multiple-joint hinges have no externally visible components, a correction of the door position that is achieved by an adjustment of the hinges is not visible from outside.

Due to an external axis, single axis hinges have a large opening angle of 180-270°, for example. Generally, they comprise a two-dimensional adjustment means formed by a height adjustment means at the corpus-side hinge part and a lateral adjustment means in the door-side hinge part. In rare cases, a depth adjustment is realized at the corpus-side hinge part by fastening screws sitting in elongate holes.

It is often problematic to mount such a hinge to a corpus of glass or wood material and/or to a door leaf made of glass.

Therefore, it is an object of the invention to provide a hinge of the above mentioned type with a multi-dimensional adjustment, wherein this hinge can be mounted in a simple manner to a corpus of glass or wood material and/or to a door made of glass.

This object is achieved with the features of claim 1.

The invention advantageously provides that the corpus-side and the door-side hinge parts each comprise a flange part for attachment or adhesion on a surface, and a height and depth adjustment means is arranged in the corpus-side flange part and comprises at least a first fastening element by means of which the adjusted height and depth position of the door-leaf can be fixed relative to the corpus.

The present invention thus offers the advantage that a hinge which comprises at least a height and depth adjustment means can be mounted in a simple manner to a corpus of glass or wood material and/or to a door leaf made of glass.

Preferably, the hinge is a single-axis hinge with one joint axis.

The door-side hinge part may comprise a means for lateral adjustment.

The corpus-side hinge part may comprise a fork part receiving the joint axis and a connecting part hinged to the fork part in a pivotable manner.

The connecting part may be inserted in the door-side flange part, the connecting part being adapted to be manually displaced in the lateral adjustment direction along guide means and to be locked in a desired position by means of a second fastening element.

The fork part may be inserted in the corpus-side flange part, the fork part being adapted to be displaced, along guide means, in the height adjustment direction, using a height adjustment means, and in the depth adjustment direction, using a depth adjustment means, and to be locked in a desired position using the first fastening means.

The fork part can be connected with a cross part, the fork part being slidable, relative to the cross part, in the height adjustment direction in parallel to the joint axis.

Together with the fork part connected with the cross part, the cross part can be supported in the corpus-side flange part such that it is displaceable in the depth adjustment direction.

Due to the fact that the fork part is displaceable in the height direction relative to the cross part and the cross part, together with the fork part, is displaceable in the depth direction relative to the flange part, a very compact structure of the hinge can be realized. This structure requires only little structural space, while a multidimensional functionality of the hinge is ensured.

The fork part, together with the cross part, forms the height adjustment means, wherein the cross part, which is stationary in the height adjustment direction relative to the corpus-side flange part, comprises an elongate recess extending parallel to the joint axis, which is adapted to receive a tool for height adjustment which, when turned, meshes with a toothing provided at the longitudinal edge of the recess, the tool engaging into the fork part, whereby the fork part becomes displaceable in the height adjustment direction.

This is advantageous in that a height adjustment means can be realized in the corpus-side flange part, which is very compact and requires very little structural space.

The cross part and the corpus-side flange part together form the depth adjustment means, wherein an elongate recess is provided that extends orthogonally to the joint axis and is adapted to receive a tool for depth adjustment, which, when turned, meshes with a toothing provided at the longitudinal edge of the recess, the tool engaging into the cross part, whereby the cross part and the fork part connected with the cross part become displaceable in the depth adjustment direction.

This is advantageous in that a very compact depth adjustment means can be realized which requires little structural space.

The flange part of the corpus-side hinge part, resting on the corpus, may be of a plate-shaped design and have a low profile with respect to the corpus.

The height and depth adjustment means, as well as the fastening elements can be adapted to be handled using the same tool.

The tool may be a multiple toothing tool, especially an internal cylindrical hexagonal key. This may be a Torx spanner.

The first and the second fastening element may be formed by screws which fix the fork part, together with the cross part, or the connecting part in the current position when the screws are tightened.

Preferably, the corpus-side flange part is also adhered to a glass surface.

The following is a detailed description of an embodiment of the invention with reference to the drawing.

Figure 2:
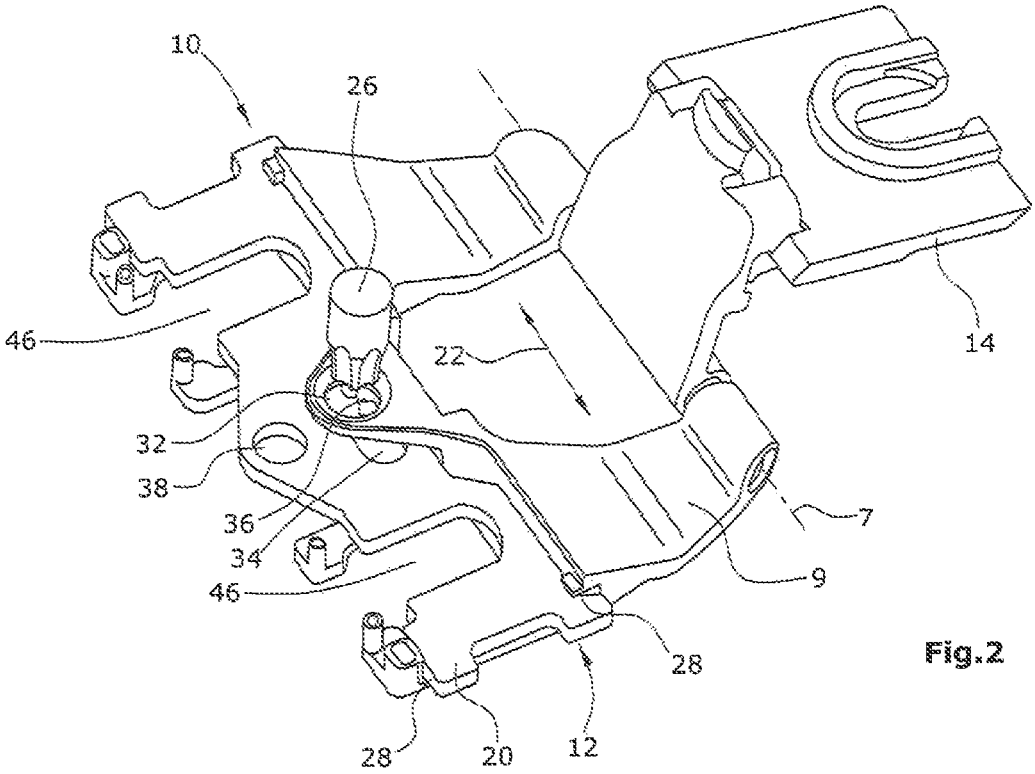
Figure 3:
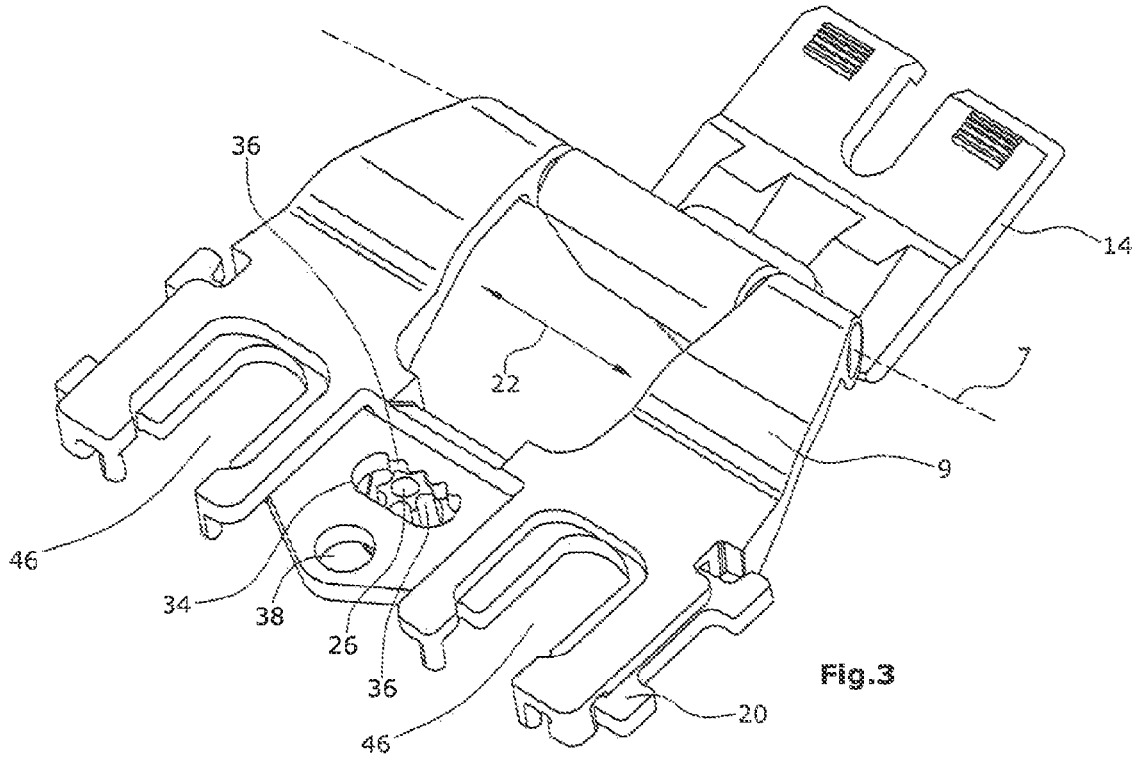
Figure 4:
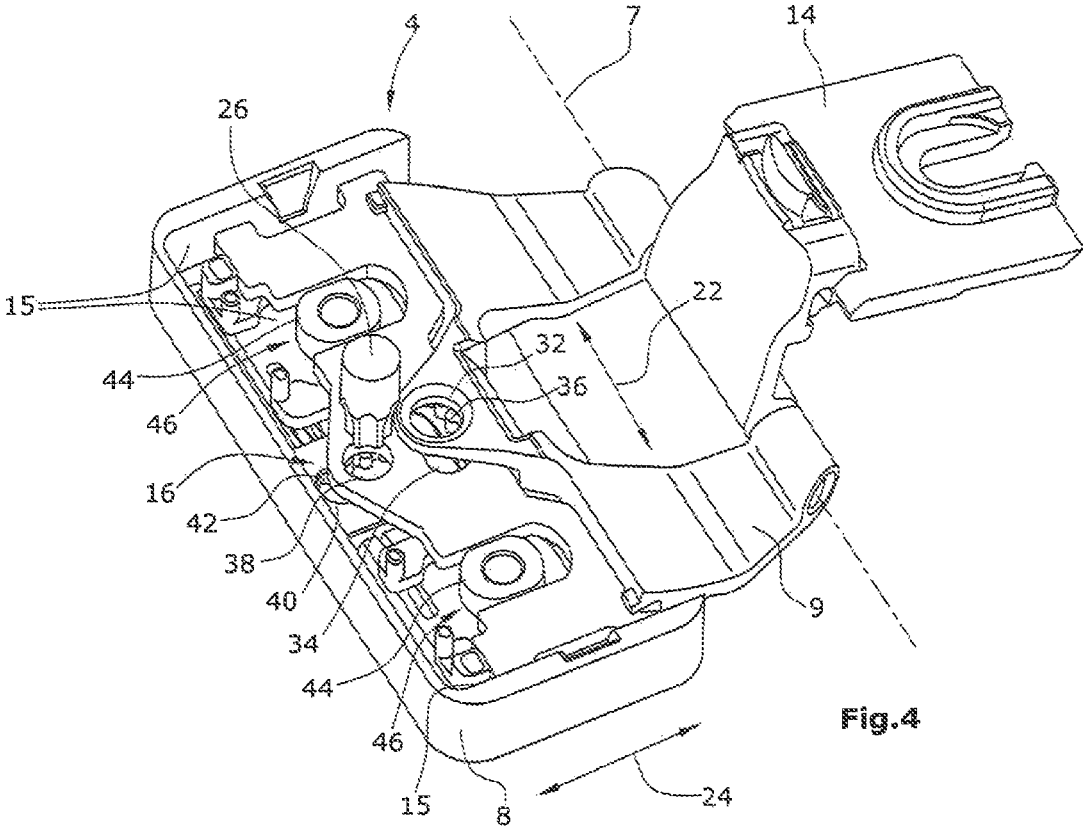
Figure 5:
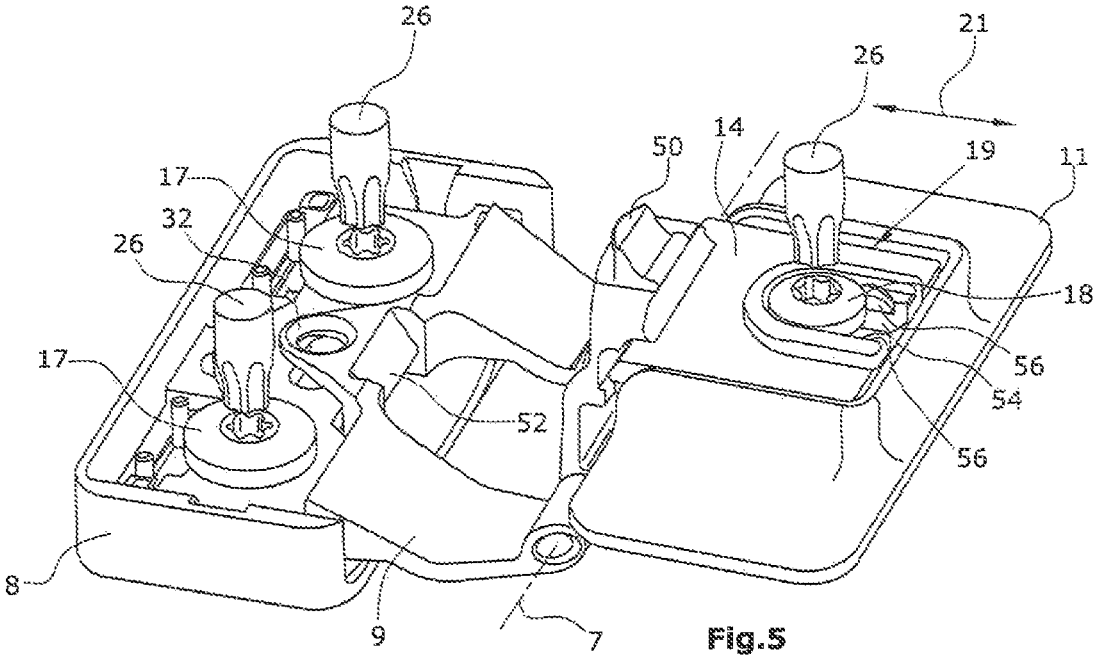

In the Figures:

FIG. 1 illustrates a hinge of the present invention attached to a corpus formed by a glass plate and a door leaf formed by a glass plate, FIG. 2 illustrates a part of the hinge in FIG. 1, FIG. 3 illustrates a part of the hinge in FIG. 2 seen from below, FIG. 4 illustrates the parts of the hinge shown in FIGS. 2 and 3 inserted into a corpus-side flange part, FIG. 5 illustrates the parts shown in FIGS. 2 and 3 inserted into a corpus-side and a door-side flange part.

FIG. 1 illustrates a hinge having a hinge part 4 adapted to be pre-assembled to a corpus 2. The corpus 2 is made of glass. Further, a door leaf 3 with a door-side hinge part 6 adapted to be pre-assembled is shown. The door leaf 3 is also made of glass. The corpus-side and the door-side hinge part 4, 6 each have a flange part 8 and 11, respectively. The corpus-side flange part 8 is adhered on the corpus 2 which is designed as a glass surface. The door-side flange part 11 is adhered on the door leaf 3 designed as a glass surface.

As an alternative, the corpus 2 may also be made from wood material. In this case, the corpus-side flange part 8 is screwed to the corpus 2 by means of longer screws 17.

The hinge parts 4 and 6 are connected for articulation. The corpus-side hinge part 4 comprises a fork part 9 receiving a joint axis 7. The fork part 9 is inserted into the corpus-side flange part 8. A connecting part 14 pivotable about the joint axis 7 is arranged at the fork part 9. The connecting part 14 is inserted into the door-side flange part 11.

The hinge illustrated in FIG. 1 is a single-axis hinge. The door leaf 3 is adapted to be pivoted about the joint axis 7 relative to the corpus 2.

A height and depth adjustment means 10, 16 is arranged in the corpus-side flange part 8.

Further, the hinge comprises at least a first fastening element 17 by means of which the set height and depth positions of the door leaf 3 can be fixed relative to the corpus 2. The height and depth adjustment means 10, 16, as well as the first fastening element 17 are illustrated in more detail in FIGS. 2 to 5. In FIG. 1, a cover 64 is removably attached on the side of the flange part 8 averted from the corpus. The cover 64 can be detached from the corpus-side flange part 8 by means of the closure elements 61.

The cover 64 may also be adapted to be pushed into slots (not illustrated in the Figs.) at the upper edge of the flange part 8, provided in the inner side was of the flange part 8. Thereby, the cover 64 is secured against falling out and cannot get lost.

In FIGS. 4 and 5, the flange part 8 is illustrated without the cover 64.

The connecting part 14 inserted into the door-side flange part 11 is adapted to be manually displaced in the lateral adjustment direction along first guide means 13. The lateral adjustment direction 21 extends orthogonal to the joint axis 7 and along the surface of the door leaf 3 onto which the door-side flange part 11 is adhered.

The connecting part 14 can be locked in a desired position with respect to the door-side flange part 11 by means of a second fastening element 18. The second fastening element 18 is a screw. The lateral adjustment means 19 will be explained in detail in the context of FIG. 5.

The fork part 9 is inserted in the corpus-side flange part 8 and is adapted to be displaced in the height adjustment direction 22 by means of a height adjustment means 10. The height adjustment direction extends parallel to the joint axis 7. The height adjustment means 10 is illustrated in detail in FIG. 2. The height adjustment means 10 is formed by the fork part 9 and the cross part 20. The fork part 9 can be displaced along a second guide means 12. In the present embodiment, the second guide means 12 is the cross part 20 itself. The fork part 9 is displaced, relative to the cross part 20, in the height adjustment direction 22 along the side faces 28 and 30 of the cross part 20.

A recess 34 is provided in the cross part 20. The recess 34 extends in parallel with the height adjustment direction 22. The recess 34 has a toothing 36 on a longitudinal face. The fork part 9 has a hole or a bore 32, the hole or bore 32 being provided above the recess 34 of the cross part 20 so that a tool 26 can be introduced through the hole 32 into the recess 34. The tool 26 may be a multi-toothing tool, for example, such as a Torx spanner. By turning the tool 26, the fork part 9 is adjusted in the height adjustment direction 22 along the second guide means 12.

The fork part 9 encloses the cross part 20 so that the fork part 8 is fixedly connected with the cross part 20 in the depth direction 24 and can only be moved together in the depth direction 24.

In FIG. 3, the hinge parts of FIG. 2 are illustrated seen from below. FIG. 3 shows how a tool 26 is received in the recess 34 and meshes with the toothing 36.

In FIG. 4 the hinge parts of FIGS. 3 and 2 are inserted in the corpus-side flange part 8. The fork part 9, together with the cross part 20, is adapted to be displaced along third guide means 15 in the depth adjustment direction 24. In the present embodiment the third guide means 15 are formed by two pins 44 connected with the corpus-side flange part 8 and by the side faces 48 of the corpus-side flange part 8. The pins 44 engage in elongate holes 46 of the cross part 20 and the cross part 20 slides along the side faces 48 of the corpus-side flange part 8.

The corpus-side flange part 8 has a recess 40 extending in the depth direction 24 and thus extending orthogonally to the height adjustment direction 22. A longitudinal side of the recess 40 comprises a toothing 42. The cross part 20 has a hole or a bore 38 provided above the recess 40 of the flange part 8 so that a tool 26 can be inserted through the hole 38 into the recess 40. The tool 26 is a multi-toothing tool so that it can be engaged with the toothing 32 through the hole 28. By turning the tool, the cross part 20, together with the fork part 9 connected therewith, is adjusted in the depth direction 24. Thus, the tool 26 engages into the cross part 20 and meshes with the toothing 42 of the recess 40.

In this manner it is possible to realize a flange part adapted for adhesion on a glass sheet, since it has a low structural height and is compact and comprises both a height adjustment means and a depth adjustment means.

In FIG. 5, the hinge parts illustrated in FIGS. 2 and 3 are inserted in the corpus-side flange part 8 and the door-side flange part 11. Together with the fork part 9, the cross part 20 is fastened to the corpus-side flange part 8 by means of the first fastening elements 17, so that the fork part 9 and the cross part 20 can be fixed in a certain position. The fastening elements 17 are screws that are adapted to be screwed into threaded bores in the pins 44. The head of the screws abuts on the cross part 20. When the screws are tightened, the cross part 20 and that part of the fork part that extends below the cross part 20 between the cross part 20 and the flange part 8, are clamped between the screws and the flange part 8.

The connecting part 14 is mounted in the door-side flange part 11. The connecting part 14 is adjustable in the lateral adjustment direction along the guide means 13. The connecting part 14 can be locked on the door-side flange part 8 by means of the second fastening element 18. In the present embodiment, the second fastening element 18 also is a screw by which the connecting part 14 is fixed to the door-side flange part 11.

The lateral adjustment means 19 is formed by the connecting part 14 and the door-side flange part 11. The door-side flange part 11 also comprises a pin that is similar to the pins 44 of the flange part 8. The connecting part 14 has an elongate hole 54, the fastening element engaging into this hole. The door-side flange part 11 has a threaded bore so that the second fastening element 18 can be screwed into this threaded bore. A surface 56 is provided along this elongate hole 54 on which the head of the second fastening element 18 abuts, so that by screwing in the second fastening element 18 the connecting part 14 can be clamped, and the connecting part 14 an thus be locked in a position relative to the door-side flange part 11.

The connecting part 14 further comprises a tongue 50 which in the folded state of the hinge 1 engages the locking means 52 so that the hinge is maintained closed in the folded state and can only be opened by applying some force.

The invention claimed is:

1. A single-axis hinge, comprising a corpus-side hinge part which is mounted on a side wall of a corpus and a door-side hinge part which is mounted on a side wall of a door leaf, wherein the corpus-side hinge part comprises a fork member, which receives a joint axis, and a connecting part pivotably articulated to the fork member, the fork member comprising two horizontally extending legs spaced apart from one another, wherein the hinge parts are connected to each other in an articulated manner with the joint axis, a height and depth adjusting device is arranged in a corpus-side flange part to adjust the fork member in a height adjustment direction vertically relative to the sidewall of the corpus and parallel to the joint axis and in a depth adjustment direction horizontally relative the side wall of the corpus and orthogonal to the joint axis and has at least one first fastening element setting height and depth position of the door leaf in relation to the corpus, wherein the corpus-side hinge part has the corpus-side flange part mounted or adhered onto, and supported by, only a single flat surface of the side wall of the corpus, and wherein the door-side hinge part has a door-side flange part mounted or adhered onto, and supported by, only a single flat surface of the side wall of the door leaf.

2. The hinge of claim 1, wherein the flat surface of the side wall of the corpus or door leaf is a glass surface.

3. The hinge of claim 1, wherein the door-side hinge part comprises a lateral adjustment means in the flange part mounted or adhered onto the flat surface of the side wall of the door leaf.

4. The hinge of claim 3, wherein the connecting part is inserted into the door-side flange part, is adapted to be manually displaced in the lateral adjustment direction along at least one first guide means, horizontally relative to the side wall of the door leaf, and is fixable in a desired position by means of a second fastening element.

5. The hinge of claim 1, wherein the fork member is inserted into the corpus-side flange part, is displaceable in the height adjustment direction by means of a height adjustment means and in a depth direction by means of a depth adjustment means, respectively, along a second and a third guide means, and is fixable in a desired position by means of the first fastening element.

6. The hinge of claim 1, wherein the corpus-side hinge part comprises a cross part and wherein the fork member is connected with the cross part, the fork member being displaceable relative to the cross part in the height adjustment direction parallel to the joint axis.

7. The hinge of claim 6, wherein the cross part, together with the fork member, is supported in the corpus-side flange part for displacement in the depth adjustment direction.

8. The hinge of claim 6, wherein the fork part forms the height adjustment means together with the cross part, the cross part, which is stationary in the height adjustment direction, comprising an elongate recess extending in parallel with the joint axis, the recess being adapted to receive a tool for height adjustment, which tool, when it is turned, meshes with a toothing provided on a longitudinal side of the recess as the tool engages into the fork member, whereby the fork member is displaceable in the height adjustment direction parallel to the joint axis.

9. The hinge of claim 6, wherein the cross part forms the depth adjustment means together with the corpus-side flange part, the corpus-side flange part comprising an elongate recess orthogonal to the joint axis, the recess is formed to receive a tool for depth adjustment, which tool, when it is turned, meshes with a toothing provided on a longitudinal side of the recess as the tool engages into the cross part, whereby the cross part is displaceable in the depth adjustment direction together with the fork member connected therewith.

10. The hinge of claim 1, wherein the flange part of the corpus-side hinge part, which rests on the side wall of the corpus, is plate-shaped and has a low structural height with respect to the corpus.

11. The hinge of claim 4, wherein both the fastening elements and the height and depth adjustment means can be operated with the tool.

12. The hinge of claim 8, wherein the tool is a multi-toothing tool, in particular an inner cylindrical hexagonal spanner.

13. The hinge of claim 6, wherein the first and the second fastening element are screws that fix the fork member, together with the cross part, and the connecting part in the current position by tightening the screws.

* * * * *